US007782259B2

(12) United States Patent
Ohashi et al.

(10) Patent No.: US 7,782,259 B2
(45) Date of Patent: Aug. 24, 2010

(54) PATTERN ANTENNA, TAG ANTENNA AND PATTERN TRANSMISSION PATH

(75) Inventors: Tsuyoshi Ohashi, Hashima (JP); Takeshi Asano, Nagoya (JP); Yuji Shinkai, Handa (JP); Katsuo Minakata, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 96 days.

(21) Appl. No.: 12/049,503

(22) Filed: Mar. 17, 2008

(65) Prior Publication Data

US 2008/0238784 A1 Oct. 2, 2008

(30) Foreign Application Priority Data

Mar. 28, 2007 (JP) ..... 2007-085339

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/795, 846

See application file for complete search history.

(56) References Cited

U.S. PATENT DOCUMENTS 7,205,944 B2 * 4/2007 Lee ..... 343/700 MS

FOREIGN PATENT DOCUMENTS

| | | | |
|---|---|---|---|
| JP | H01-158801 | A | 6/1989 |
| JP | H09-270629 | A | 10/1997 |
| JP | 2000-114827 | A | 4/2000 |
| JP | 2003249815 | A | 9/2003 |
| JP | 2004303962 | A | 10/2004 |
| JP | 2006-197440 | A | 7/2006 |
| JP | 2006197440 | A | 7/2006 |

OTHER PUBLICATIONS

Japan Patent Office, Notice of Reasons for Rejection in counterpart Patent Application No. JP 2007-085339 mailed Aug. 3, 2009.

Japan Patent Office; Office Action in Japanese Patent Application No. 2007-085339 (counterpart to the above-captioned U.S. patent application) mailed Dec. 10, 2009 (partial translation).

* cited by examiner

*Primary Examiner*—Hoang V Nguyen
(74) *Attorney, Agent, or Firm*—Baker Botts, LLP.

(57) ABSTRACT

In an antenna formed by a substantially thin-plate state conductive member on a base material, a surface area expanding portion is provided at least substantially at a center part in a direction orthogonal to a direction in which an electric current flows. The surface area expanding portion is a projection portion provided in a projecting state with respect to a peripheral portion (or a concave portion arranged concaved than the peripheral portion). A width dimension of the projection portion (or the concave portion) in a cross-sectional face is twice or more of a skin depth of the electric current in the cross sectional face.

10 Claims, 9 Drawing Sheets

[FIG. 1A]
(a)
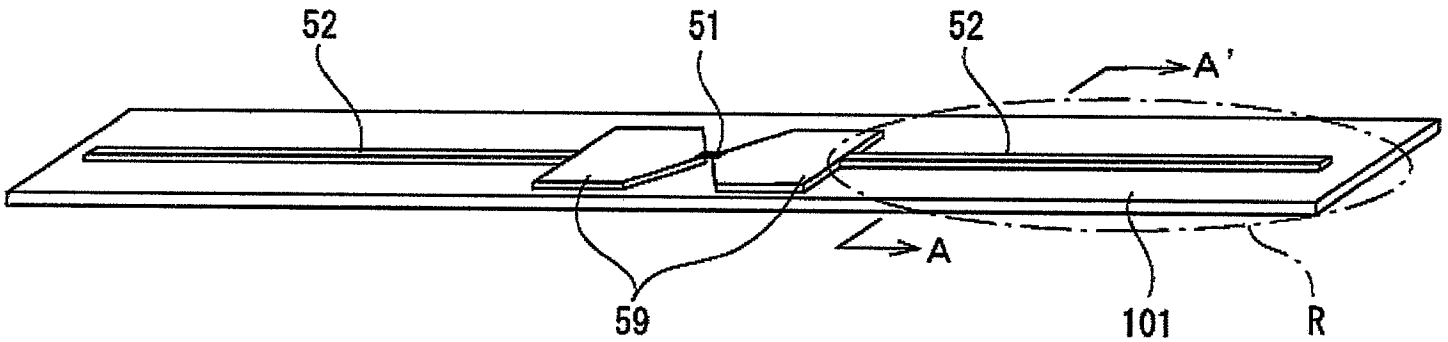
[FIG. 1B]
(b)
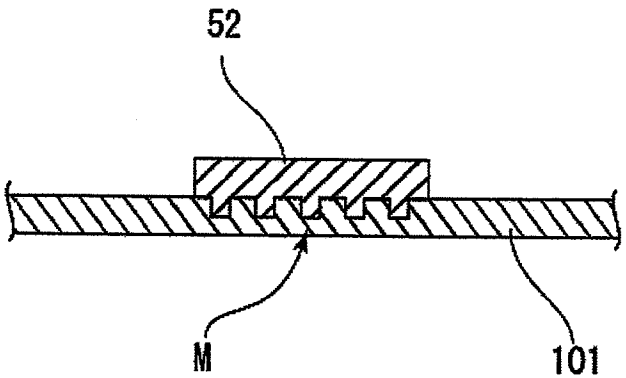

[FIG. 2A]
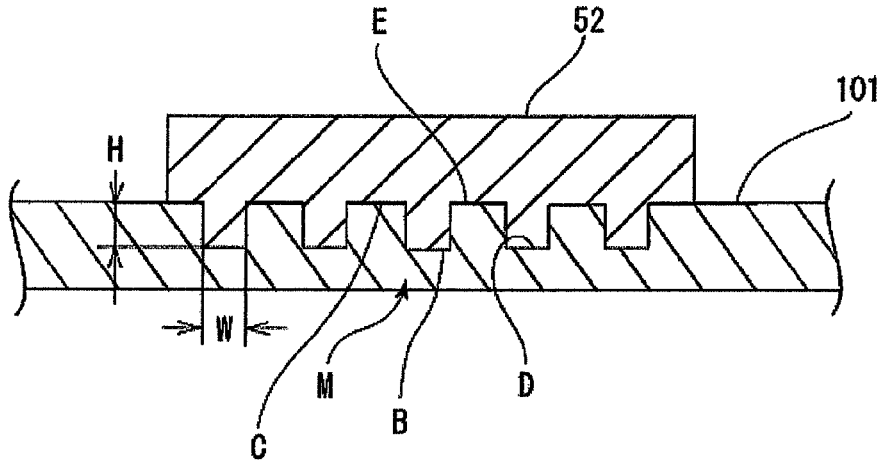
[FIG. 2B]
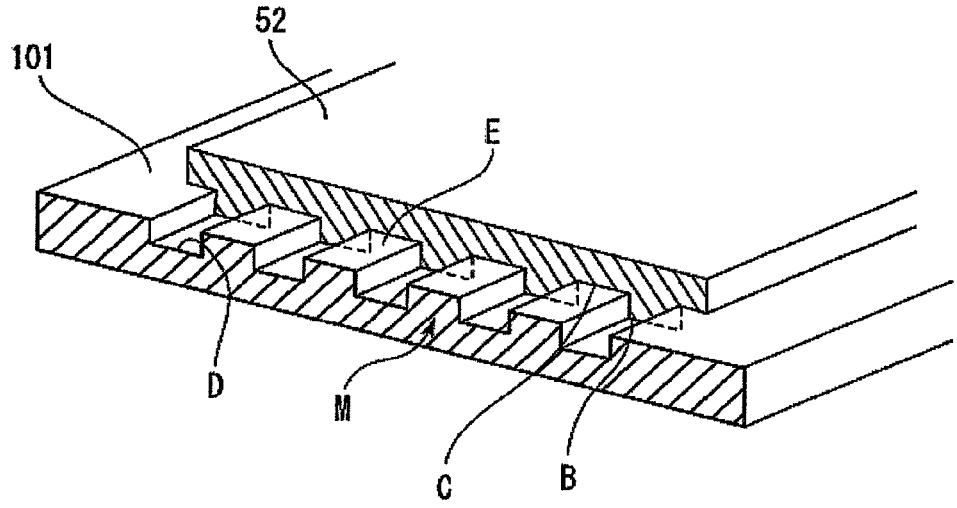

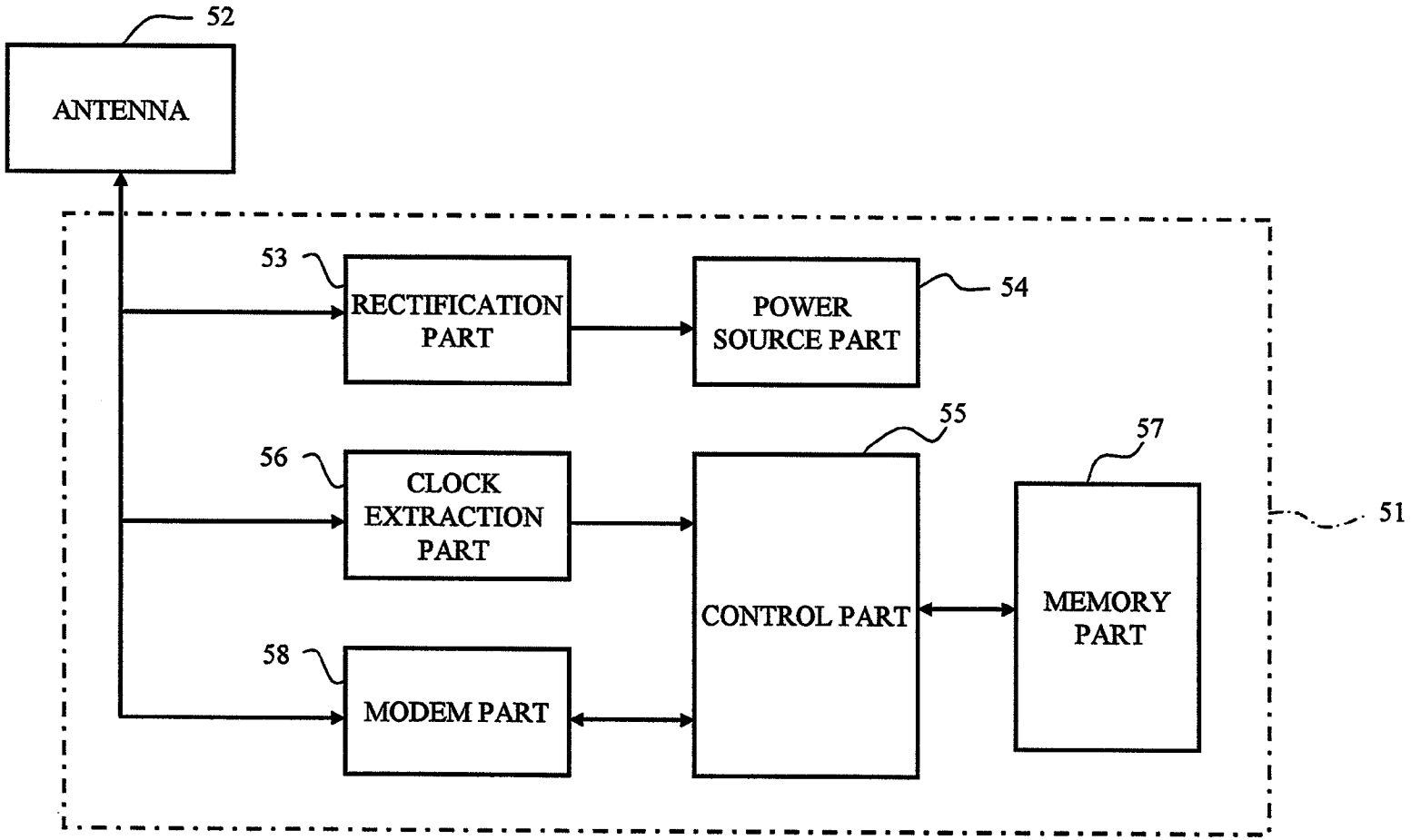
[FIG. 3]

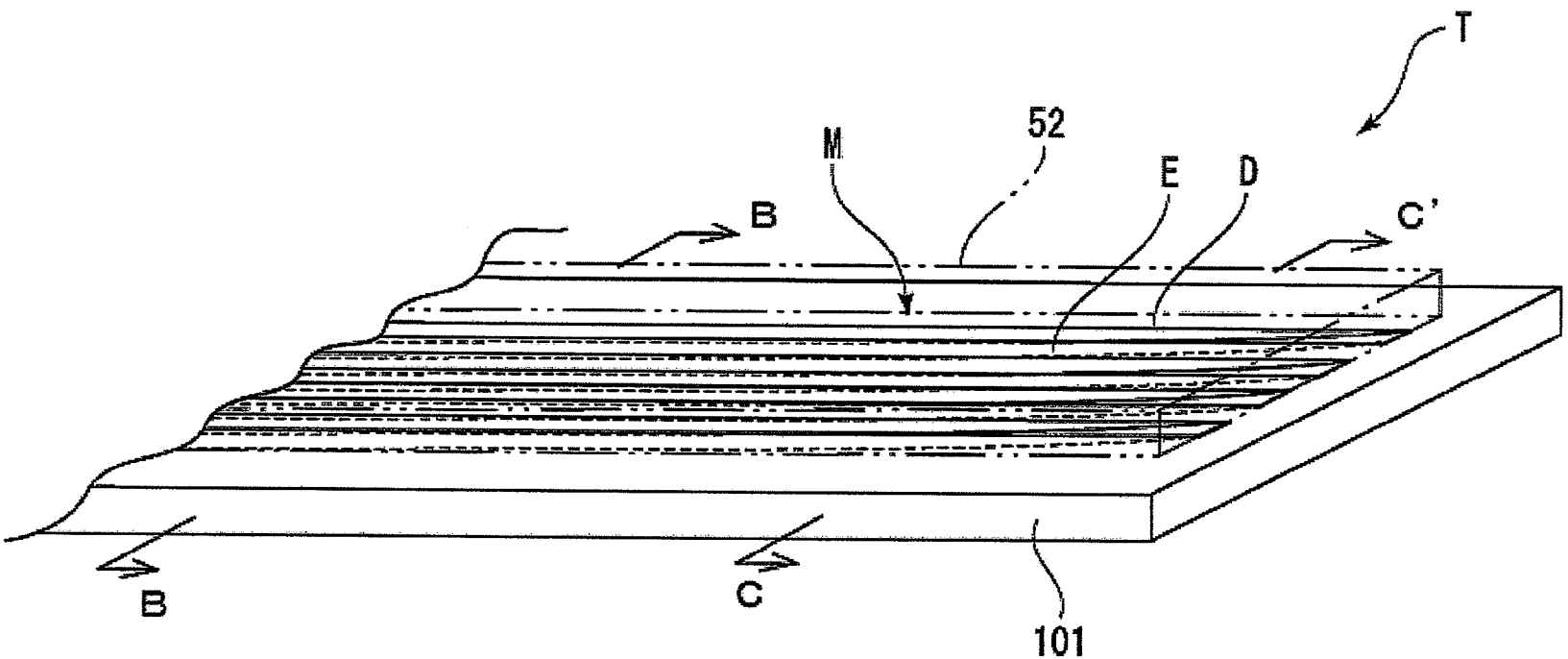
[FIG. 4]

[FIG. 5A]
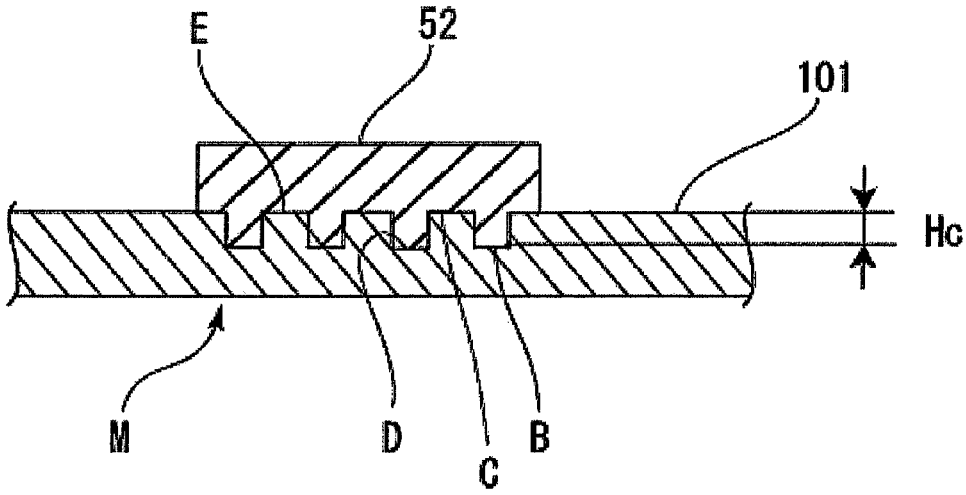
[FIG. 5B]
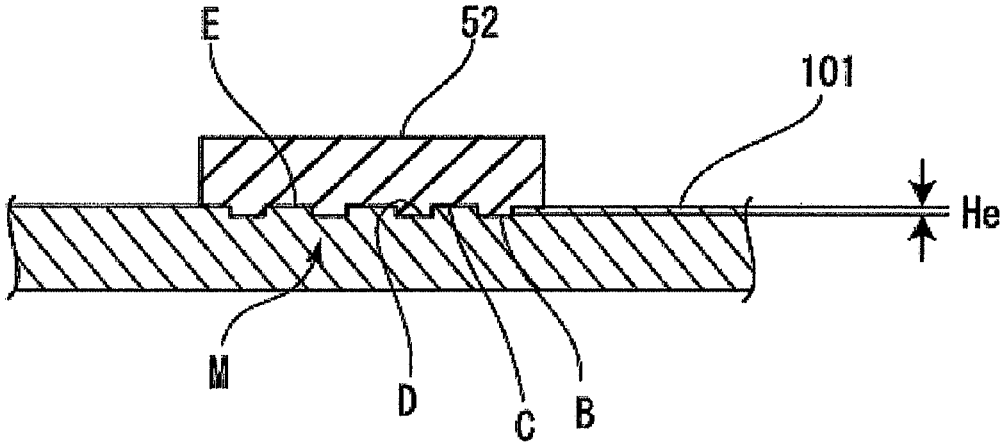

[FIG. 6]
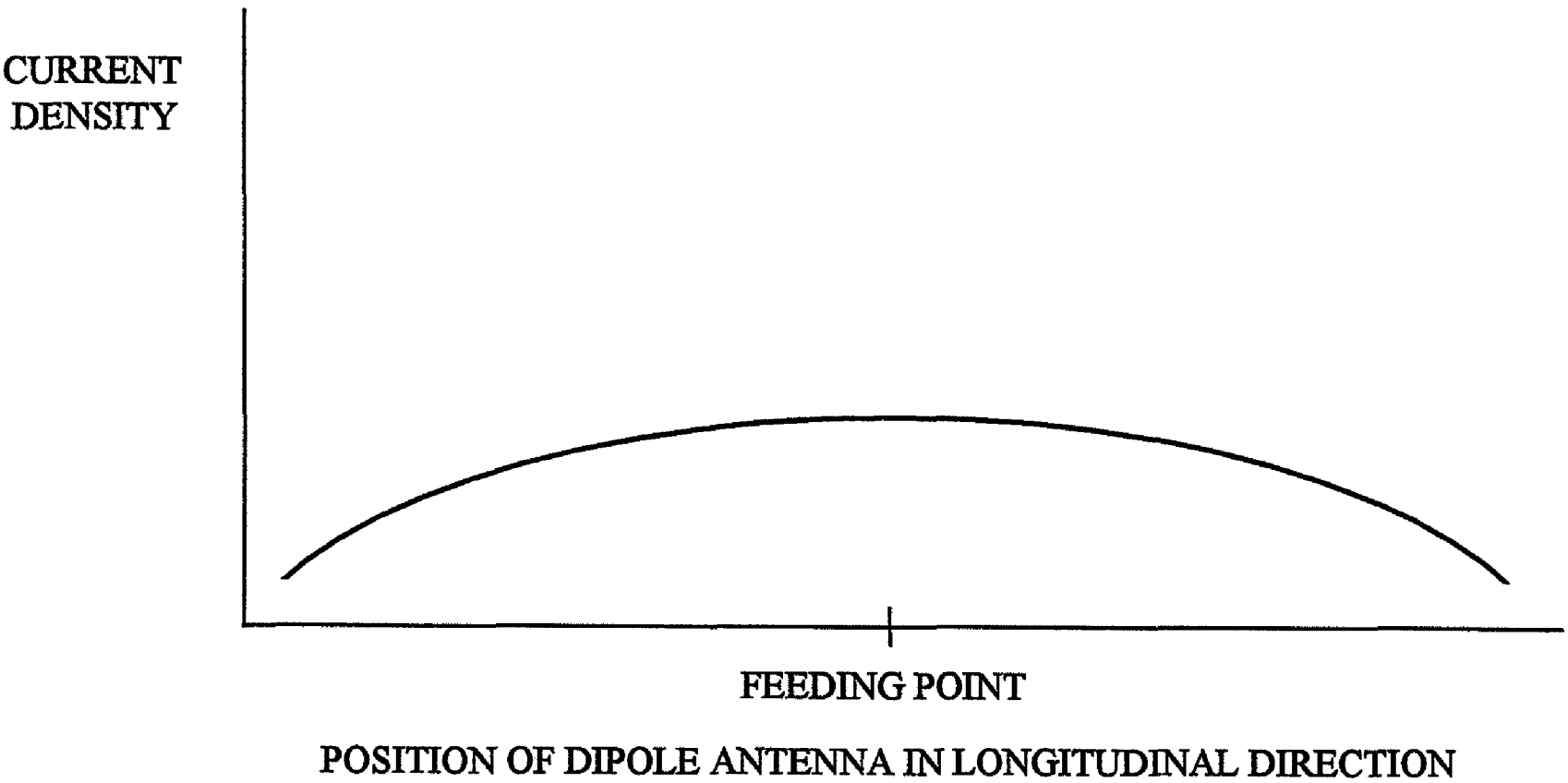

[FIG. 7]
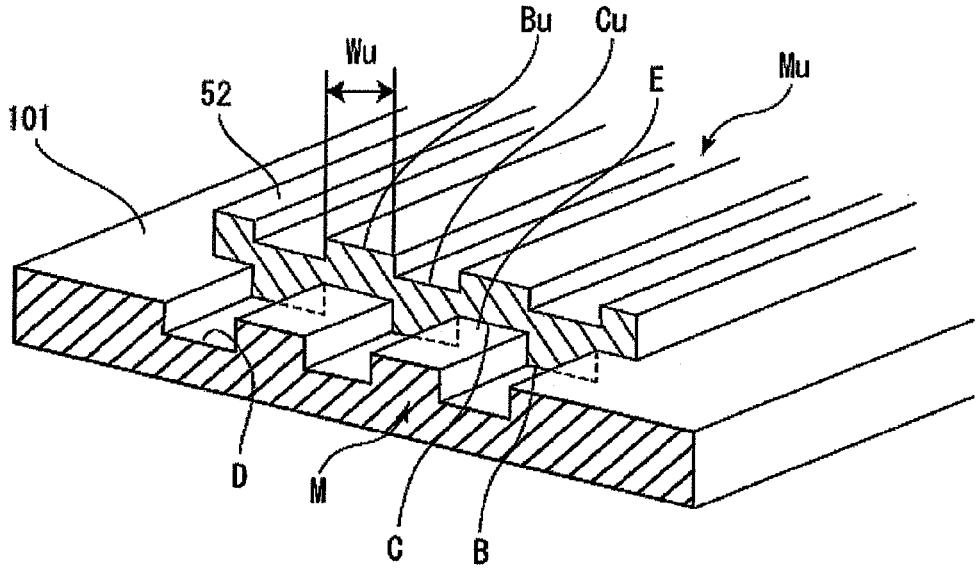
[FIG. 8]
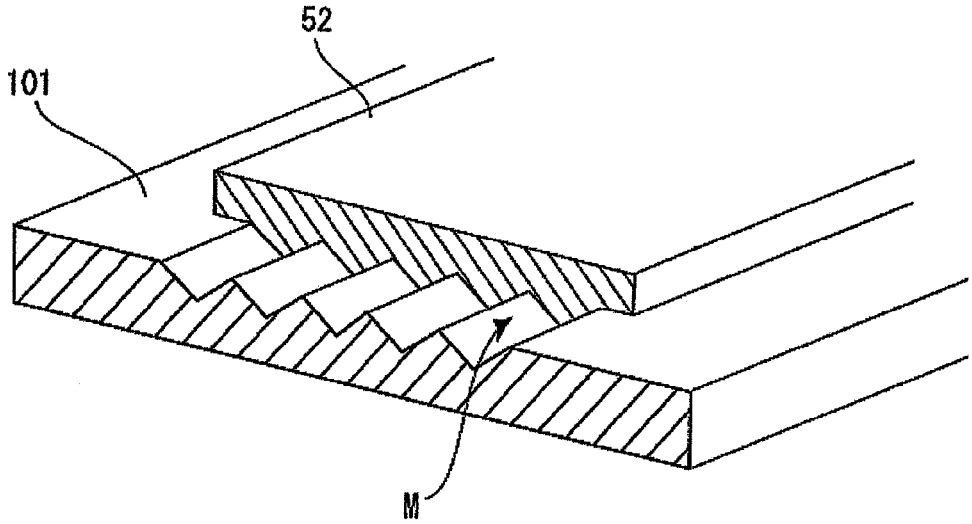

[FIG. 9]
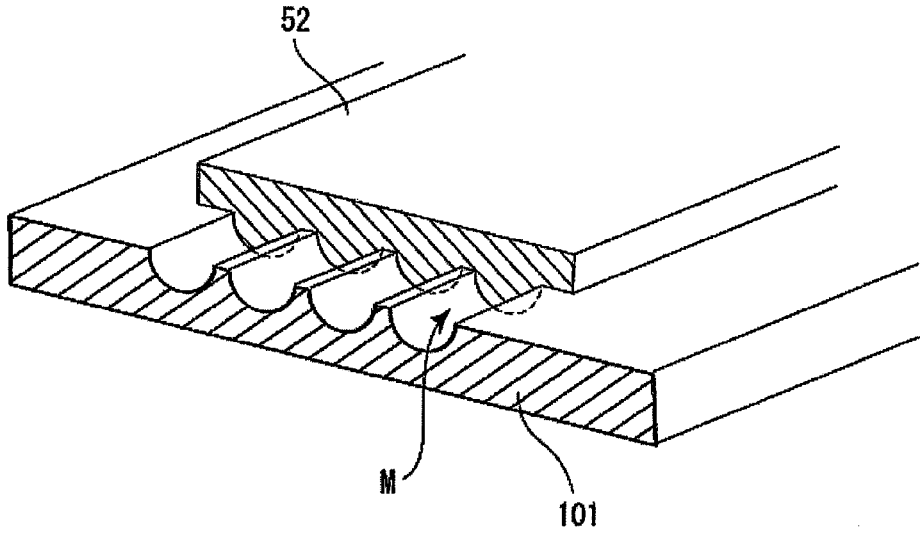
[FIG. 10]
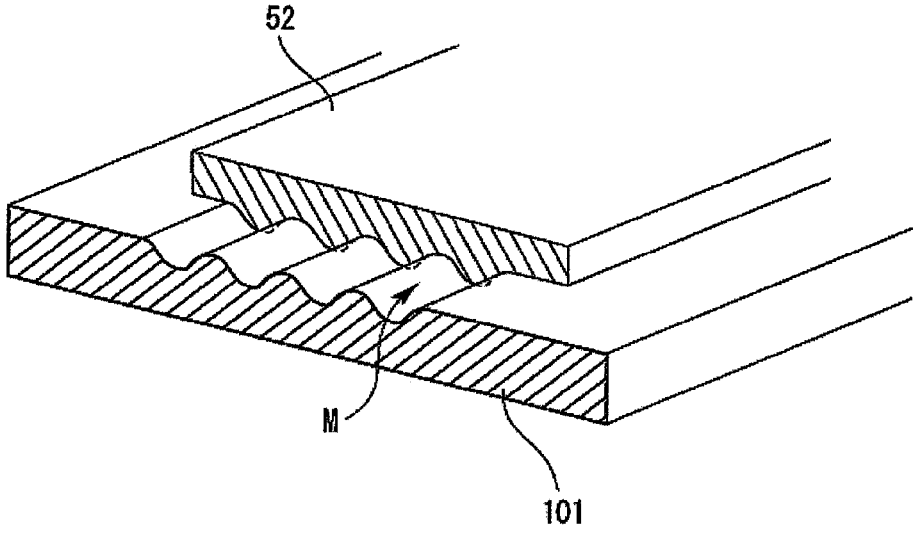

[FIG. 11A]
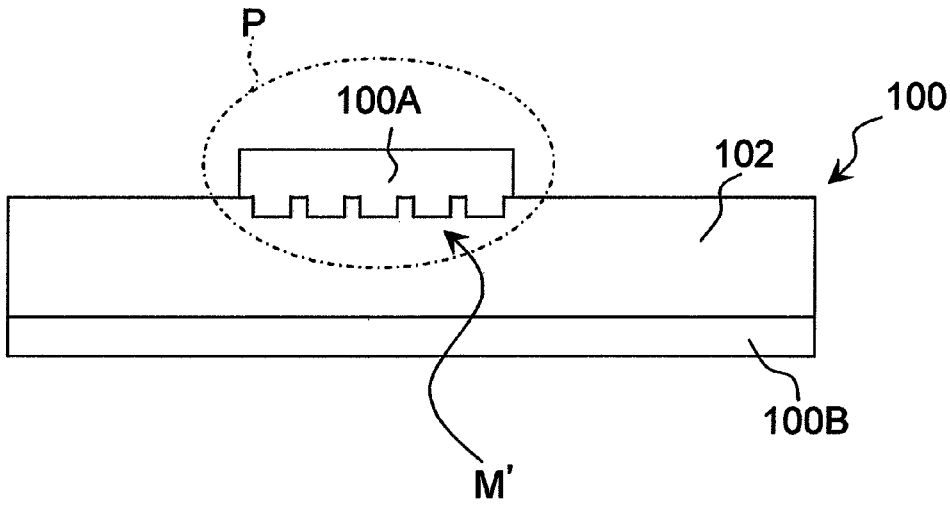
[FIG. 11B]
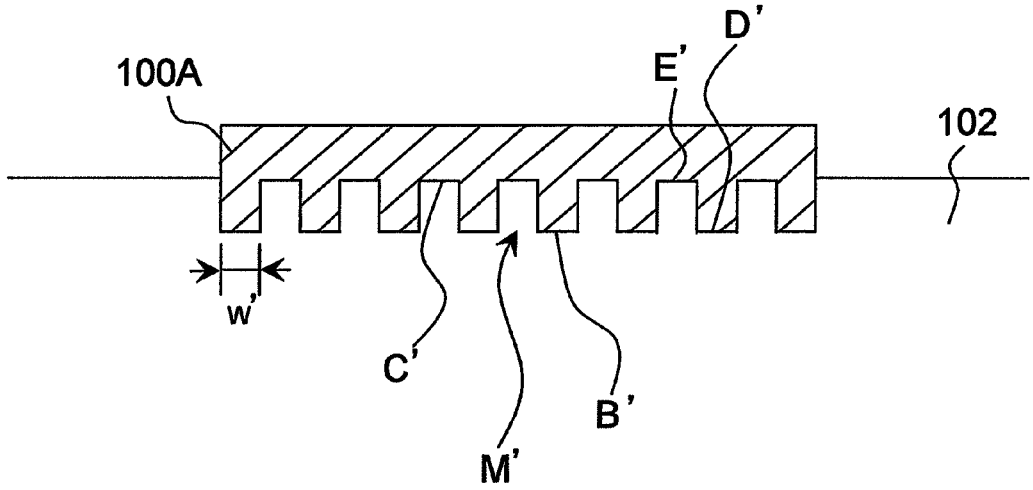

PATTERN ANTENNA, TAG ANTENNA AND PATTERN TRANSMISSION PATH

CROSS-REFERENCE TO RELATED APPLICATIONS

This application claims priority from JP 2007-85339, filed Mar. 28, 2007, the contents of which are hereby incorporated by reference.

BACKGROUND OF THE INVENTION

1. Field of the Invention

The present invention relates to a pattern antenna on which a pattern of a conductor is formed on a substrate, a tag antenna using the same, and a pattern transmission path.

2. Description of the Related Art

A RFID (Radio Frequency Identification) system configured to read/write information contactlessly between a small-sized RFID tag and a reader (reading device)/writer (writing device) is known, for example. Even if the RFID tag is stained or arranged in a hidden place, the reader/writer can make an access (reading/writing of information) to RFID tag information of an IC circuit part, practical use has already progressed in various fields including product management and inspection process.

The RFID tag is provided with an IC circuit part storing predetermined information and a tag antenna connected to this IC circuit part for transmission and reception of information. Specific configuration of this tag antenna has been conventionally proposed as described in JP, A, 2006-197440, for example.

With this related art, when a tag antenna is to be manufactured, a conductive paste is formed by printing on the surface of a base material substantially in a rectangular shape and coagulated so as to configure an antenna circuit conductor. At this time, a concave portion is formed in advance at a portion corresponding to both-end edge portions of the conductive paste in a base-material width direction (in other words, a direction orthogonal to a direction in which an electric current flows). By forming the conductive paste in this state, formation of a cross-sectional face with an acute-angle shape caused by occurrence of dripping before coagulation is prevented at the both-end edge portions, and loss by skin effect is reduced.

SUMMARY OF THE INVENTION

However, in the above related art, skin effect is prevented at both ends of a conductor in a base-material width direction (direction orthogonal to a direction in which an electric current flows) and an electric-current passage region is increased only in that portion, and increase of the electric-current passage region is not particularly considered in portions other than that. Therefore, in order to obtain predetermined communication performance, it is necessary to increase a dimension of an entire antenna in the direction (width direction) orthogonal to the current direction, which makes size reduction difficult.

In antennas for uses other than a tag antenna, an antenna may be configured by forming a pattern on a base material through printing or other methods, which has the same problem as above.

Moreover, in a transmission path for transmitting a radio frequency signal, a transmission path may be configured by forming a pattern on the base material by printing or other methods as mentioned above, which has the same problem as above, too.

The present invention has an object to provide a pattern antenna, a tag antenna and a pattern transmission path which can reduce the size by sufficiently increasing an electric-current passage region.

BRIEF DESCRIPTION OF THE DRAWING

FIG. 1A is a perspective view illustrating an entire structure of a RFID label provided with a tag antenna according to an embodiment of the present invention and FIG. 1B is a cross-sectional view in an A-A' section in FIG. 1A.

FIG. 2A is a partially extracted and enlarged view of FIG. 1A illustrating detailed configuration of a surface area expanding portion and FIG. 2B is a perspective view schematically illustrating a structure shown in FIG. 2A.

FIG. 3 is a functional block diagram illustrating a functional configuration of a RFID circuit element provided at the RFID tag.

FIG. 4 is a view corresponding to the extracted and enlarged view of an R part in FIG. 1A illustrating a structure of an essential part of an antenna according to a variation in which a projection portion height is changed along the current flowing direction.

FIGS. 5A and 5B are a cross-sectional view by a B-B' section in FIG. 4 and a cross section by a C-C' section in FIG. 4, respectively.

FIG. 6 is an explanatory diagram illustrating distribution of current density in a dipole antenna.

FIG. 7 is a perspective view schematically illustrating a structure of a surface area expanding portion of a variation in which the projection and concave is also provided on the side opposite the base material of the antenna.

FIG. 8 is a schematic perspective view illustrating a variation of a surface area expanding portion with a substantially triangular sectional shape.

FIG. 9 is a schematic perspective view illustrating a variation of a surface area expanding portion with a substantially arc-state sectional shape.

FIG. 10 is a schematic perspective view illustrating a variation of a surface area expanding portion with a substantially wave-shaped sectional shape.

FIG. 11A is a cross-sectional view illustrating a configuration of a variation in which the present invention is applied to a micro-strip line and FIG. 11B is an extracted and enlarged view of a P part in FIG. 11A.

DETAILED DESCRIPTION OF THE PREFERRED EMBODIMENTS

An embodiment of the present invention will be described referring to the attached drawings.

FIG. 1A is a perspective view illustrating an entire structure of a RFID label provided with a tag antenna according to this embodiment, and FIG. 1B is a cross-sectional view of an A-A' section in FIG. 1A.

In FIGS. 1A and 1B, the RFID label T has a base material 101 made of an appropriate material such as PET and thermal paper, an IC circuit part 51 (IC chip; IC circuit part for RFID label), an antenna 52 (tag antenna), and an electrode (connection terminal for antenna) 59 provided on the base material 101.

The IC circuit part 51 has a function to store information and a function to retransmit information by modulating a wave received at the antenna 52 by an information signal (details will be described later). The electrode 59 is for connecting the IC circuit part 51 and the antenna 52 to each other and is formed integrally at the IC circuit part 51 in this example.

The antenna 52 is extended substantially linearly on one side and the other side of the IC circuit part 51 along an electric-current flowing direction (direction perpendicular to the paper surface in FIG. 2A), respectively, and constitutes an antenna element of a so-called dipole antenna. This antenna 52 is configured by a substantially thin-plate state conductive member (in this example, formation by printing using a conductive ink or conductive paste and then, being cured. Alternatively, it may be configured by plating, etching, ink jet, press and the like) (print pattern antenna). In the antenna 52, a surface area expanding portion M is provided on a side in contact with the base material 101 (lower side in FIG. 1B) and at least at a central region (substantially over the entire region in the width direction in this example) in the width direction (direction orthogonal to the direction in which the current is flowing, in the right and left direction in FIG. 1B) of the base material 101.

FIG. 2A is partially extracted and enlarged view of FIG. 1A illustrating detailed configuration of the surface area expanding portion M and FIG. 2B is a perspective view schematically illustrating a structure shown in FIG. 2A.

In FIGS. 2A and 2B, the surface area expanding portion M on the antenna 52 is provided with a plurality of projection portions B arranged projecting than a peripheral portion C (portion other than the projection portions B. Relatively, it makes a concaved state). That is, on the base material 101, a plurality of concave portions D arranged concaved than the peripheral portion E (portions other than the concave portion D) are provided in order to form the projection portion B. Supplying the conductive paste on the surface of the base material 101 including the plurality of concave portions D and curing it forms the projection portion B having a shape matching the concave portion D. As a result, the surface area expanding portion M has a substantially comb-tooth shaped section in general.

At this time, the width direction of the base material 101 of the projection portion B on the cross sectional face (in other words, a direction orthogonal to the current-flowing direction. The horizontal direction in FIG. 2A) is a dimension W (hereinafter, referred to as "projection portion width W" as appropriate), and the base-material thickness direction of the projection portion B (vertical direction in FIG. 2A) is a dimension H (hereinafter referred to as "projection portion height H" as appropriate). The projection portion width W is configured to be twice or more of the skin depth δ in this cross-sectional face, that is:

$$W \geqq 2\delta.$$

The skin depth δ will be described. In general, the higher the frequency of a signal becomes when a signal current is flowing through a conductor, the less current flows in an internal region since the current concentrates on the surface region of the conductor (skin effect). The depth from the surface of the region where the current flows at this time is the skin depth δ. When an angular velocity of the current is ω, a magnetic permeability of the conductor is μ, and conductivity is σ, it is represented as:

$$\delta=\{2/(\omega\mu\sigma)\}[m].$$

If it is the projection portion width W<2, the electric current substantially does not flow in the projection portion B due to the skin effect and does not contribute to increase of a current passage region. In this embodiment, by setting projection portion width W≧2 as above, the current passage region can be surely increased by the projection portion height H.

FIG. 3 is a functional block diagram illustrating a functional configuration of a RFID circuit element provided at the RFID label T.

In FIG. 3, the RFID label T has the antenna 52 for performing signal transmission and reception contactlessly with an antenna on the side of an apparatus for communicating with a RFID tag, not shown, and the IC circuit part 51 connected to the antenna 52. The antenna 52 and the IC circuit part 51 constitute the RFID circuit element.

The IC circuit part 51 is provided with a rectification part 53 configured to rectify an interrogation wave from the apparatus for communicating with a RFID tag received by the antenna 52, a power source part 54 for accumulating energy of the interrogation wave rectified by the rectification part 53 and making it as a driving power source, a clock extraction part 56 configured to extract a clock signal from the interrogation wave received by the antenna 52 and supply it to a control part 55, a memory part 57 that can store a predetermined information signal, a modem part 58 connected to the antenna 52, and the control part 55 configured to control operation of the entire RFID circuit element through the memory part 57, the clock extraction part 56, the modem part 58 and the like.

The modem part 58 demodulates the communication signal received by the antenna 52 from the apparatus for communicating with a RFID tag, modulates the interrogation wave received at the antenna 52 and retransmits it as a response wave from the antenna 52 based on a reply signal from the control part 55.

The control part 155 executes basic control such as interpretation of a received signal demodulated by the modem part 158, generation of a reply signal based on the information signal stored in the memory part 157, and replying it by the modem part 58.

The clock extraction part 56 extracts a clock component from a received signal to the control part 55 and supplies the clock corresponding to a frequency of a clock component of the received signal to the control part 55.

The antenna 52 of this embodiment configured as above has the following advantages.

That is, when a conductive member in substantially a thin-plate state is formed so as to configure a pattern antenna (by printing in the above example), the electric current has a tendency that it flows only in the vicinity of the surface of the antenna conductor due to the above-mentioned skin effect. Thus, in order to obtain predetermined communication performance as a RFID label, it is necessary to increase a dimension in a direction orthogonal to the current direction of the entire antenna. In the antenna 52 of this embodiment, by providing the surface area expanding portion M (in this example, the surface area is expanded by an increase action of the outer edge length by projection and concave of the projection portion B and the peripheral portion C), the region where the electric current passes can be sufficiently increased without increasing the width-direction dimension of the entire antenna 52. As a result, the size of the entire antenna 52 can be reduced while ensuring the radio communication performance equivalent to those before.

Also, when communication is performed in a UHF band using a dipole antenna for the RFID label, the skin effect tends to occur remarkably in general. In this embodiment, by providing the surface area expanding portion M particularly in the antenna 52, which is such a dipole antenna, the size of the antenna can be effectively reduced.

Particularly, in this embodiment, by providing the surface area expanding portion M on the side in contact with the base material 101, a contact area with the base material 101 is increased, and there is also an advantage that peeling-off preventing effect of the print pattern from the base material 101 can be improved.

An example that the antenna 52 is configured as a dipole antenna with the antenna element extending substantially linear on both sides of the IC circuit part 51, respectively, has been described but not limited to that. That is, it may be configured as a modified dipole antenna with the antenna element in a crank shape (rectangular zigzagged state) extending on both sides of the IC circuit part, respectively. There can be application to antennas in other shapes.

The present invention is not limited to the above embodiment but capable of various variations in a range not departing from its technical idea and gist. The variations will be described below.

(1) When the projection portion height is changed along the current-flowing direction:

FIG. 4 is a view corresponding to the extracted and enlarged view of the R part in FIG. 1A illustrating a structure of an essential part of the antenna 52 according to this variation (the antenna 52 is shown by a virtual line in order to clarify the structure by looking through). FIG. 5A is a cross-sectional view on a B-B' section in FIG. 4, FIG. 5B is a cross-sectional view on a C-C' section in FIG. 4, and both correspond to FIG. 1B and FIG. 2A.

In FIGS. 4, 5A, and 5B, in the antenna 52 in this variation, the projection portion height H in the cross-sectional face of the projection portion B is set variable along the current-flowing direction (horizontal direction in FIG. 4, and direction perpendicular to the paper surface in FIGS. 5A and 5B) corresponding to current density in each cross-sectional face. That is, the height He of the projection portion at both ends in the current flowing direction (=longitudinal direction of the base material 101) shown in FIG. 5B is set smaller than the height Hc of the projection portion at the center part in the current flowing direction shown in FIG. 5A.

That is, as shown in FIG. 6, the current distribution of the dipole antenna is large in the vicinity of a feeding point and smaller at both ends of the element.

In correspondence with that, the projection portion height H is reduced at both end portions where the current density is smaller and the projection portion height H is increased at the center where the current density is large as mentioned above so that the antenna 52 with favorable communication efficiency can be formed while restricting wasteful consumption of conductive ink.

(2) When a projection and a concave is also provided on the side opposite the base material 101 of the antenna 52:

FIG. 7 is a perspective view schematically illustrating a structure of the surface area expanding portions M and Mu (which will be described later) of this variation and corresponds to FIG. 2B of the above embodiment.

In FIG. 7, in the antenna 52 of this variation, the surface area expanding portion Mu is also provided on the side (upper side in the figure) opposite the base material 101, in addition to the surface area expanding portion M provided on the above-mentioned side (lower side in the figure) of the base material 101.

The surface area expanding portion Mu is, similarly to the surface area expanding portion M, provided with a plurality of projection portions Bu arranged projecting than peripheral portions Cu (portions other than the projection portions Bu. It relatively makes a concave state). With respect to the upper side in the figure of the cured conductive paste as mentioned above, the projection portion Bu is formed by cutting or press working. As a result, the surface area expanding portion Mu has a substantially comb-tooth shaped section in general.

At this time, similarly to the above, a dimension (projection portion width) Wu in the width direction of the base material 101 of the projection portion Bu on the cross-sectional face (in other words, a direction orthogonal to the current-flowing direction. Horizontal direction in FIG. 7) may be set twice or more of the skin depth δ in this cross-sectional face, and the similar effect can be obtained in this case.

According to this variation, by providing the surface area expanding portions M, Mu on both the side in contact with the base material 101 and the opposite side, the current passage region can be remarkably increased and the size of the antenna 52 in general can be surely reduced.

It may be so configured that only the surface area expanding portion Mu is provided and the surface area expanding portion M on the side of the base material 101 is omitted. In this case, the effect to increase the current passage region similar to the above embodiment can be obtained.

(3) Various sectional shapes of the surface area expanding portion:

In the embodiment and variations of (1) and (2) described above, the surface area expanding portion M or Mu has a substantially comb-tooth shaped section in general, but not limited to that. That is, the surface area expanding portion M may have various sectional shapes such as a substantially triangular shape as shown in FIG. 8, a substantially arc shape as shown in FIG. 9, a substantially wave shape as shown in FIG. 10 and the like (though not shown, the same applies to the surface area expanding portion Mu on the side opposite the base material 101). Also, the above various shapes may be combined (including partial combination). The same effect can be also obtained in these cases.

(4) When the present application is applied to those other than antennas (transmission path):

That is, a case where the present invention is applied to the antenna has been described as an example above, but not limited to that, the present invention may be applied to those other than antennas such as a transmission path for transmitting a radio frequency signal. Examples of the transmission path include a micro-strip line used for connection of a circuit or parts on a substrate (different from coaxial cables or the like used for connection between units) in transmission of a micro wave.

FIG. 11A is a cross-sectional view illustrating a configuration of a variation in which the present invention is applied to the micro-strip line and corresponds to FIG. 1B in the above embodiment. FIG. 11B is an extracted and enlarged view of a P part in FIG. 11A and corresponds to FIG. 2A.

In FIGS. 11A and 11B, a micro-strip line 100 is provided with a conductor 100A on one side (upper side in the figure) and a conductor 100B on the other side (lower side in the figure) and a base material 102 made of a dielectric body with a permittivity ∈ between them in the middle.

The conductor 100A, here, is made by a substantially thin-plate state conductive member (obtained by printing using a conductive ink or conductive paste and then, curing it in this example. Or it may be configured by plating, etching, ink jet or press.) similar to the antenna 52 (transmission path: print pattern transmission path). In the conductor 100A, a surface area expanding portion M' is provided at least at a central region (over the substantially entire region in the width direction in this example) on the side (lower side in FIG. 11A and FIG. 11B) in contact with the base material 102 and in the width direction of the base material 102 (direction orthogonal to the current-flowing direction, horizontal direction in FIGS. 11A and 11B).

The surface area expanding portion M' is provided with a plurality of projection portions B' arranged projecting than peripheral portions C' (portions other than the projection portion B'). That is, in order to form the projection portion B', a plurality of concave portions D' arranged concaved than peripheral portions E' (portions other than the concave portion D') are provided in the base material 102. Supplying the conductive paste to the surface of a base material 101' including the plurality of concave portions D' and curing those forms the projection portions B' in the shape matching that of the concave portions D'. As a result, the surface area expanding portion M' has a substantially comb-tooth shaped section in general.

As mentioned above in the above embodiment, by configuring a projection portion width W' to be twice or more of the skin depth in the cross-sectional face, the same effect can be obtained.

(5) Others:

In the above, a structure in which the projection and concave is realized (and moreover, various settings are made as appropriate for the sizes of the projection portion height and projection portion width in the cross sectional face) by arranging the projection portions B projecting, Bu, and B' with respect to the peripheral portions C, Cu, and C' in the surface area expanding portions M, Mu, and M' provided at the antenna 52 or the conductor 100A (as the transmission path) has been described as an example, but not limited to that. That is, the projection and concave may be realized (and moreover, various settings are made as appropriate for the sizes of the concave portion depth and concave portion width in the cross sectional face) by arranging a concave portion concaved than the peripheral portion. In this case, too, the same effect as that when the projection portion is used can be obtained.

Other than described above, methods in the above embodiment and variations may be combined as appropriate for use.

Though not shown individually, the present invention is put into practice with various changes in a range not departing from its gist.

What is claimed is:

1. A pattern antenna comprising a substantially thin-plate state conductive member formed on a base material, comprising:

a surface area expanding portion provided at least at a substantially center part of the conductive member in a width direction, the surface area expanding portion expands a surface of the conductive member in a direction orthogonal to a direction in which an electronic current flows, wherein:

said pattern antenna is a print pattern antenna comprising a conductive ink as said conductive member, and said surface area expanding portion is provided on the side opposite to the side in contact with said base material.

2. A pattern antenna comprising a substantially thin-plate state conductive member formed on a base material, comprising:

a surface area expanding portion provided at least at a substantially center part of the conductive member in a width direction, the surface area expanding portion expands a surface of the conductive member in a direction orthogonal to a direction in which an electronic current flows, wherein:

said pattern antenna is a print pattern antenna comprising a conductive ink as said conductive member, and said surface area expanding portion is provided on the side in contact with said base material and on the opposite side thereof, respectively.

3. A pattern antenna comprising a substantially thin-plate state conductive member formed on a base material, comprising:

a surface area expanding portion provided at least at a substantially center part of the conductive member in a width direction, the surface area expanding portion expands a surface of the conductive member in a direction orthogonal to a direction in which an electronic current flows, wherein:

said pattern antenna is a print pattern antenna comprising a conductive ink as said conductive member, and said surface area expanding portion comprises at least one of a projection portion and a concave portion, the projection portion projects from a peripheral portion and the concave portion concaves into the peripheral portion in a cross-section of said surface area expanding portion, wherein the peripheral portion extends in a lengthwise direction along the direction in which the electric current flows.

4. The pattern antenna according to claim 3, wherein:

said surface area expanding portion has a shape selected from the group consisting of substantially comb-tooth state, substantially triangular, substantially arc-state, and substantially wave-shaped cross-sectional shapes.

5. The pattern antenna according to claim 4, wherein:

a height dimension of said projection portion in the cross-section or a depth dimension of said concave portion in the cross-section varies along said current-flowing direction based on a current density across the cross-section.

6. The pattern antenna according to claim 5, wherein:

said height dimension at both end portions in said current-flowing direction is less than that at the center part in said current-flowing direction.

7. The pattern antenna according to claim 6, wherein:

said pattern antenna is configured as a dipole antenna extended along said current-flowing direction.

8. The pattern antenna according to claim 3, wherein:

a width dimension in said orthogonal direction of said projection portion or said concave portion in the cross-section is at least twice a skin depth of the electric current in the cross-section.

9. The pattern antenna according to claim 3, wherein:

the height dimension of said projection portion in the cross-section or the depth dimension of said concave portion in the cross-section varies along said orthogonal direction based on a current density across the cross-section.

10. A tag antenna comprising a substantially thin-plate state conductive member formed on a base material so as to be connected to an IC circuit part for an RFID tag configured to store information and arranged on said base material, comprising:

a surface area expanding portion provided at least at a substantially center part of the conductive member in a width direction, the surface area expanding portion expands a surface of the conductive member in a direction orthogonal to a direction in which an electric current flows, wherein:

said tag antenna is a print pattern antenna comprising a conductive ink as said conductive member, and said surface area expanding portion is at least one of a projection portion arranged projecting from a peripheral portion and a concave portion arranged concaved into a peripheral portion.

* * * * *